US008093827B2

(12) United States Patent
Lee et al.

(10) Patent No.: US 8,093,827 B2
(45) Date of Patent: Jan. 10, 2012

(54) LIGHT SOURCE MODULE, LIGHT SOURCE ASSEMBLY HAVING THE SAME AND DISPLAY DEVICE HAVING THE LIGHT SOURCE MODULE

(75) Inventors: Yong-Woo Lee, Suwon-si (KR); Jin-Hee Park, Cheonan-si (KR); Seong-Sik Choi, Seoul (KR); Joo-Young Kim, Asan-si (KR)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 416 days.

(21) Appl. No.: 12/358,811

(22) Filed: Jan. 23, 2009

(65) Prior Publication Data

US 2009/0256492 A1 Oct. 15, 2009

(30) Foreign Application Priority Data

Apr. 11, 2008 (KR) ..... 10-2008-0033884

(51) Int. Cl.
*H05B 41/36* (2006.01)

(52) U.S. Cl. ..... 315/291; 315/294; 315/312

(58) Field of Classification Search ..... 315/291, 315/294, 312; 362/97.1–97.3, 382
See application file for complete search history.

(56) References Cited

U.S. PATENT DOCUMENTS

2009/0207125 A1* 8/2009 Park et al. ..... 345/102

FOREIGN PATENT DOCUMENTS

| | | |
|---|---|---|
| JP | 2005-228535 | 8/2005 |
| JP | 2006-189665 | 7/2006 |
| KR | 10-0677151 | 1/2007 |

OTHER PUBLICATIONS

English abstract for Publication No. 2005-228535, Aug. 25, 2005.
English abstract for Publication No. 1020060035540 (10-0677151), Apr. 26, 2006.
English abstract for Publication No. 2006-189665, Jul. 20, 2006.

* cited by examiner

*Primary Examiner* — Daniel D Chang
(74) *Attorney, Agent, or Firm* — F. Chau & Associates, LLC

(57) ABSTRACT

A light source module includes a power transmission substrate and a plurality of point light sources. The power transmission substrate has a plurality of dimming areas disposed along a first direction. The point light sources are spaced apart from each other in each dimming area along the first direction and receive driving power applied to each dimming area through the power transmission substrate and generate light. A spatial interval between the point light sources in the first direction is greater in dimming areas more distant from the center of the power transmission substrate than in dimming areas closer to the center of the power transmission substrate.

25 Claims, 16 Drawing Sheets

300

LIGHT SOURCE MODULE, LIGHT SOURCE ASSEMBLY HAVING THE SAME AND DISPLAY DEVICE HAVING THE LIGHT SOURCE MODULE

CROSS-REFERENCE TO RELATED APPLICATION

This application claims priority under 35 U.S.C. §119 to Korean Patent Application No. 10-2008-0033884, filed on Apr. 11, 2008 in the Korean Intellectual Property Office (KIPO), the contents of which are herein incorporated by reference in their entirety.

BACKGROUND OF THE INVENTION

1. Technical Field

The present invention relates to a light source module, and more particularly, to a light source module, a light source assembly having the light source module and a display device having the light source module.

2. Discussion of the Related Art

A display device typically includes a backlight assembly providing light to a display panel so that an image may be displayed even when the amount of ambient light would be insufficient to illuminate the display panel. Examples of a light sources employed in the backlight assembly include a cold cathode fluorescent lamp (CCFL) or a lighting unit including one or more light-emitting diodes (LEDs).

Conventionally, a hold-type backlight assembly has been used. In the hold-type backlight assembly, light is generated when power is applied to the backlight assembly without regard to the displayed image. However, a dimming-type backlight assembly has recently been introduced. In the dimming-type backlight assembly, luminance of the backlight is controlled in accordance with the desired luminance of the presently displayed image so that when a darker image is being displayed, the backlight may be dimmed accordingly. This dimming of the backlight allows for a reduced power consumption and increased contrast ratio.

There are three approaches for controlling luminance in a dimming-type backlight assembly. These approaches may be characterized as 0-dimensional dimming (0-D), 1-dimensional dimming (1-D), and 2-dimensional dimming (2-D).

In 0-D dimming, only the total luminance of the backlight may be controlled and the backlight is delivered substantially evenly across the entire display panel. In the 1-D method, the backlight is divided into a set of predetermined lines, and luminance is controlled separately for each of the predetermined lines. In the 2-D method, also known as local dimming, the backlight is divided into predetermined areas, and the luminance of each area is controlled. Under this approach, the quantity of light supplied to each pixel or group of pixels of the display device may be separately controlled. In a 3-dimensional dimming (3-D) method, also known as color dimming, not only can the quantity of light supplied to each area be changed in accordance with the image being displayed, but the color of that light can be changed as well. For example, the quantity and color of light supplied to each pixel or group of pixels of the display device may be separately controlled.

Unlike a CCFL, an LED is substantially a point light source. For this reason, and other physical properties of LEDs, LED backlights may provide for low power consumption and dimming that may be driven using a variety of methods. However, LEDs may be vulnerable to heat. Accordingly, when an operating temperature of an LED exceeds a limit value when driving a point light source, the lighting efficiency of the point light source may rapidly decrease, and the usable lifespan of the point light source may be shortened. Thus, when point light sources serve as a light source of a backlight assembly, heat generated from the point light sources must be properly dissipated.

In addition, LED-based 2-D and 3-D dimming-type backlight assemblies may be relatively expensive to manufacture costs in comparison with a backlight assembly including a fluorescent lamp. Also, as the number of point light sources employed in a backlight assembly increases, the amount of heat generated from the backlight assembly and a display device having the backlight assembly also increases, thereby reducing the usable lifespan of the point light sources and the backlight assembly, decreasing efficiency, and greatly increasing manufacturing costs.

SUMMARY OF THE INVENTION

Exemplary embodiments of the present invention provide a light source module having enhanced optical efficiency.

Exemplary embodiments of the present invention also provide a light source assembly having the above-mentioned light source module.

Exemplary embodiments of the present invention also provide a display device having the above-mentioned light source assembly.

According to an aspect of the present invention, a light source module includes a power transmission substrate and a plurality of point light sources. The power transmission substrate has a plurality of dimming areas disposed in series along a first direction. The point light sources are spaced apart from each other in each dimming area along the first direction to receive driving power applied to each dimming area through the power transmission substrate and generate light. Spatial intervals between the point light sources in the first direction are greater in dimming areas father from the center of the power transmission substrate than in dimming areas closer to the center of the power transmission substrate.

In an exemplary embodiment of the present invention, as distances in the first direction from the center of the power transmission substrate to the dimming areas increase, a length in the first direction of the dimming areas may increase. The spatial intervals between the point light sources may be substantially constant in the same dimming area. Alternatively, as the point light sources are increasingly distant in the first direction from the center of the power transmission substrate, the spatial interval between the point light sources in the same dimming area may increase. The number of the point light sources disposed in the first direction may be the same in each dimming area.

In an exemplary embodiment of the present invention, the length in the first direction of the dimming areas may be substantially constant. The spatial interval between the point light sources may be substantially constant in the same dimming area. Alternatively, as the point light sources are increasingly distant in the first direction from the center of the power transmission substrate, the spatial interval between the point light sources in the same dimming area may increase.

The point light sources may be disposed in a plurality of rows substantially parallel with the first direction in each dimming area, and the dimming areas may be disposed in a plurality of rows substantially parallel with the first direction.

In an exemplary embodiment of the present invention, as the point light sources of dimming areas are farther from the edge of the power transmission substrate in the second direction, the point light sources of the dimming area may be father apart from each other. The second direction is substantially perpendicular to the first direction.

According to an aspect of the present invention, a light source assembly includes a plurality of power transmission substrates, a plurality of point light sources and a dimming drive unit. The power transmission substrates have a plurality of dimming areas disposed in series along a first direction. The power transmission substrates are disposed in series along a second direction substantially perpendicular to the first direction. The point light sources are spaced apart from each other in each dimming area along the first direction. As the point light sources of dimming areas are farther from the center of the power transmission substrate in the first direction, the point light sources of the dimming area may be father apart from each other. The dimming drive unit controls the luminance of emitted light from each dimming area by applying driving currents to the point light sources in each dimming area through the power transmission substrates.

In an exemplary embodiment of the present invention, the number of the point light sources disposed in the first direction may be the same in each dimming area. The spatial interval between the point light sources may be substantially constant in the same dimming area. Alternatively, as the point light sources of dimming areas are farther from the center of the power transmission substrate in the first direction, the point light sources of the dimming area may be father apart from each other.

In an exemplary embodiment of the present invention, as the point light sources are farther from the center of the power transmission substrates in the first direction, the number of the point light sources disposed in the first direction for each dimming area may decrease.

The point light sources may be disposed in a plurality of rows substantially parallel with the first direction in each dimming area, and the dimming areas may be disposed in a plurality of rows substantially parallel with the first direction.

In an exemplary embodiment of the present invention, as the point light sources of dimming areas are farther from the center of the power transmission substrate in the second direction, the point light sources of the dimming area may be father apart from each other.

Each of the power transmission substrates may include a plurality of printed circuit boards (PCBs) disposed in series along the first direction, and the PCBs may be independently driven by the dimming drive unit.

The dimming drive unit may include a dimming control section and a power supply section. The dimming control section generates a dimming signal that commands the driving currents applied to each dimming area in accordance with an externally received image information signal. The power supply section generates the driving currents based on externally applied power according to the dimming signal to output the driving currents to a power connection section of the power transmission substrates.

According to an aspect of the present invention, a display device includes a receiving container, a plurality of power transmission substrates, a plurality of point light sources, a display panel module and a dimming drive unit. The transmitting substrates include a plurality of dimming areas. The dimming areas are disposed in series along a first direction and are received in the receiving container to be disposed in series along a second direction substantially perpendicular to the first direction. As the point light sources of dimming areas are farther from the center of the power transmission substrate in the first direction, the point light sources of the dimming area may be father apart from each other. The display panel module is disposed over the point light sources to display an image by using emitted light from the point light sources. The dimming drive unit separately controls the luminance of the emitted light from each dimming area in accordance with an image information signal received from the display panel module.

In an exemplary embodiment of the present invention, the point light source may include a first light-generating body generating a first color light, a second light-generating body generating a second color light and a third light-generating body generating a third color light. The dimming drive unit may include a dimming control section and a power supply section. The dimming control section generates a dimming signal that commands driving currents applied to the first, second and third light-generating chips of each dimming area in accordance with the received image information signal so that the emitted light corresponds to a color of the image. The power supply section generates the driving currents based on externally applied power according to the dimming signal and outputs the driving currents to a power connection section of the power transmission substrates.

The display device may further include a side frame, an optical member and a middle frame. The side frame covers the power connection section formed on a side edge of the power transmission substrates and is disposed on a sidewall of the receiving container. The optical member is disposed between the point light sources and the display panel module. The middle frame is combined with the receiving container to compress an edge of the optical member and support the display panel module.

In an exemplary embodiment of the present invention, as the point light sources of dimming areas are farther from the center of the power transmission substrate in the second direction, the point light sources of the dimming area may be father apart from each other.

In an exemplary embodiment of the present invention, each of the power transmission substrates may include a plurality of PCBs disposed in series along the first direction, and the PCBs may be independently driven by the dimming drive unit.

According to the light source module, the light source assembly having the light source module and the display device having the light source module, the arrangement of point light sources may be changed to obtain desired display quality even while the number of point light sources is reduced. Thus, because there are fewer point light sources, the operating temperature of the backlight assembly may be reduced to increase the usable lifespan of the light source module, the light source assembly and the display device, and to reduce power consumption.

BRIEF DESCRIPTION OF THE DRAWINGS

The above and other features and aspects of the exemplary embodiments of the present invention will become more apparent by describing in detailed example with reference to the accompanying drawings in which.

DETAILED DESCRIPTION OF THE EXEMPLARY EMBODIMENTS

Figure 1:
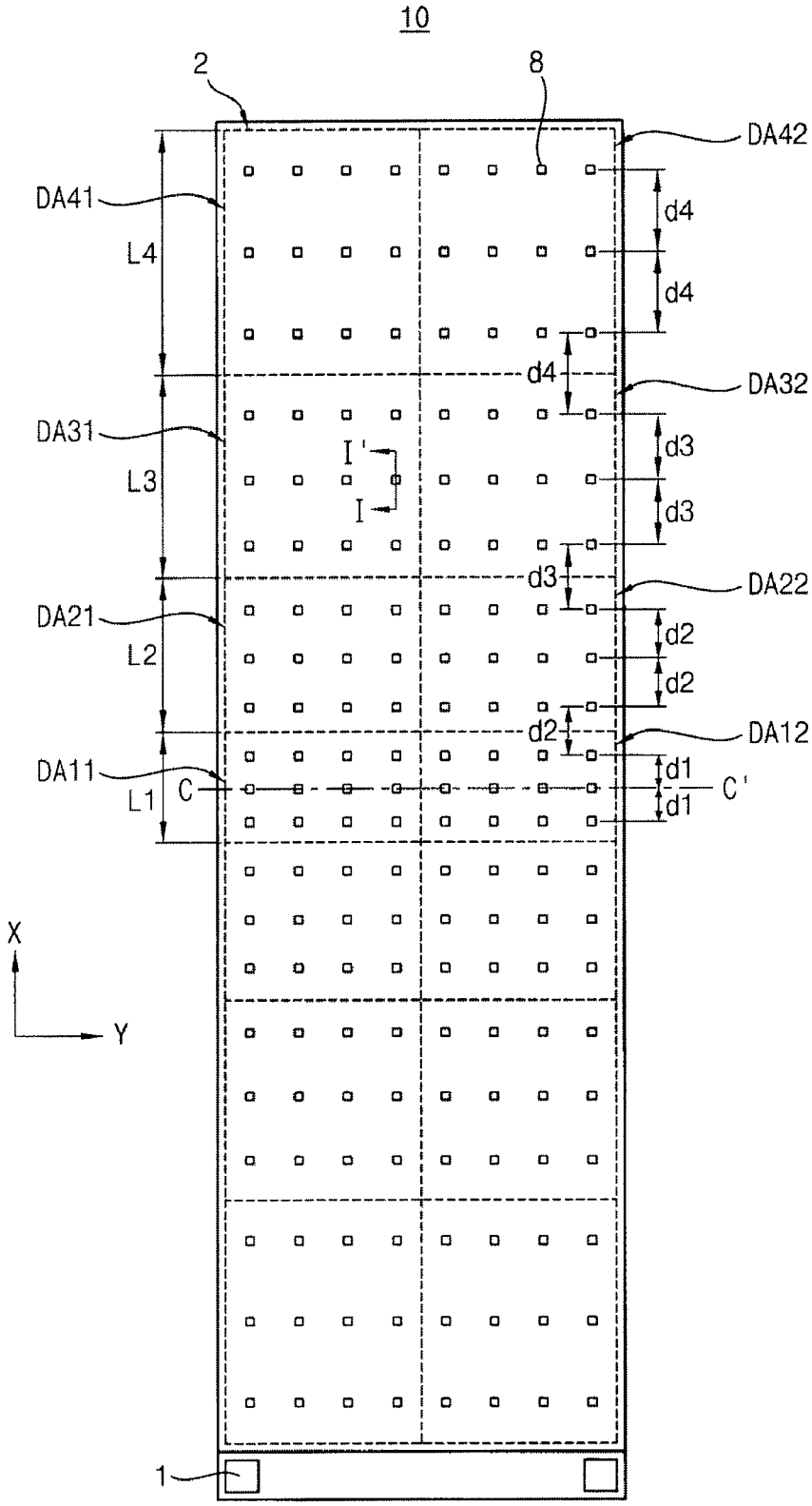
FIG. 1 is a plan view illustrating a light source module according to an exemplary embodiment of the present invention.

Exemplary embodiments of the present invention are described more fully hereinafter with reference to the accompanying drawings. The present invention may, however, be embodied in many different forms and should not be construed as limited to the exemplary embodiments set forth herein. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present.

Hereinafter, exemplary embodiments of the present invention will be explained in detail with reference to the accompanying drawings.

Figure 2:
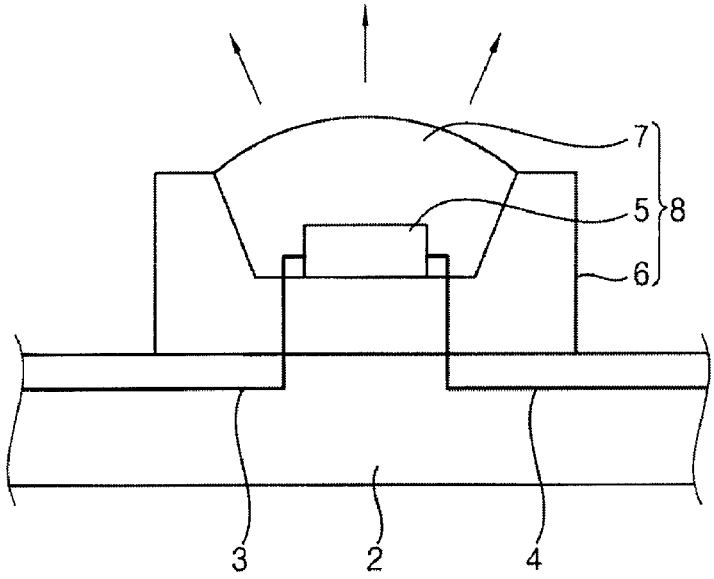
FIG. 2 is a cross-sectional view taken along a line I-I' in FIG. 1.

FIG. 1 is a plan view illustrating a light source module according to an exemplary embodiment of the present invention. FIG. 2 is a cross-sectional view taken along a line I-I' in FIG. 1.

Referring to FIGS. 1 and 2, a light source module 10 may serve as a light source of a backlight of a display device, a light source of an electronic display board, etc. The light source module 10 includes a power transmission substrate 2 and a plurality of point light sources 8.

The power transmission substrate 2 may include, for example, a metal layer, an insulation layer and a power supply wiring.

A power connection section 1 is formed at a side edge of the power transmission substrate 2. Driving power, for example, driving current may be externally applied to the power connection section 1. The insulation layer may be formed on the metal layer. The power supply wiring is electrically connected to the power connection section 1, and insulated by the insulation layer. The power supply wiring may include an input wiring 3 and an output wiring 4.

Each point light source 8 may include a light-generating chip 5, a housing 6 and a lens 7.

The light-generating chip 5 may include a diode formed by a junction of semiconductors. The housing 6 may have a box shape and the housing 6 may have an opening in a light-emission direction, for example, a normal direction of the power transmission substrate 2. The housing 6 is formed on the insulation layer, and the light-generating chip 5 is disposed on a base face of the housing 6. The input wiring 3 and the output wiring 4 are connected to an input terminal and an output terminal of the light-generating chip 5, respectively. The lens 7 covers the light-generating chip 5 and fills the opening of the housing 6. The lens 7 may include a fluorescent substance to change the wavelength of light emitted from the light-generating chip 5. When the driving current is applied to the light-generating chip 5 through the input wiring 3, the light-generating chip 5 generates light. The light emitted from the light-generating chip 5 passes through the lens 7, and the wavelength of the light is changed so that the emitted light has a desired color.

The power transmission substrate 2 may include a flat plate having a substantially rectangular shape. A direction substantially parallel with a long side of the power transmission substrate 2 is defined as a first direction x, and a direction substantially perpendicular to the first direction x, for example, a direction substantially parallel with a short side of the power transmission substrate 2 is defined as a second direction y.

The power transmission substrate 2 has a plurality of dimming areas DA11, DA21, DA31, DA41, DA12, DA22, DA32 and DA42 disposed in series along the first direction x on the insulation layer. The point light sources 8 are disposed in the dimming areas. The dimming areas may correspond to control units. The control units each control the point light sources 8 in a single dimming area.

The center of the portion of the light source module 10 that includes the dimming areas is defined as the center of the power transmission substrate 2. A line that passes through the center and is substantially parallel with the second direction y is defined as a center line C-C'. A column close to a side edge in the second direction y of the power transmission substrate 2 is defined as a first column, and a column adjacent to the first column is defined as a second column.

The number of rows and columns of the dimming areas may be modified according to optical characteristics of the emitted light of the light source module 10. In FIG. 1, seven dimming areas are disposed in series along the first direction x. The series of seven dimming areas forms a column, and as shown, there are two columns in the second direction y. Thus, 14 dimming areas are arranged in seven rows and two columns on the power transmission substrate 2.

Accordingly, the light source module 10 externally receives a driving current, and generates light having the same or different luminance from fourteen dimming areas. The center line C-C' passes through centers of the dimming areas disposed at a middle row. An upper part and a lower part of the dimming areas are substantially symmetrical with respect to the center line C-C'.

There may be multiple columns of point light sources 8 within the light source module 10. The number of columns of the point light sources 8 may be modified according to optical characteristics of the emitted light of the light source module 10. In FIG. 1, there are four columns of point light sources 8 within each dimming area column. Accordingly, there are a total of eight columns of point light sources 8 within the light source module 10.

In an exemplary embodiment of the present invention, the distance between each of the point light sources 8 in the second direction y remains substantially constant.

The point light sources 8 are spaced apart from each other in the first direction x. The spatial intervals between the point light sources 8 in the first direction x are greater in the dimming areas more distant from the center line C-C' than in the dimming areas closer to the center line C-C'.

First dimming areas DA11 and DA12, second dimming areas DA21 and DA22, third dimming areas DA31 and DA32, and fourth dimming areas DA41 and DA42 are increasingly more distant in the first direction x from a dimming area corresponding to the center line C-C'.

In an exemplary embodiment of the present invention, the spatial interval between the point light sources 8 in the first direction x is substantially constant within an individual dimming area. Thus, the point light sources 8 in the first dimming areas DA11 and DA12 are spaced apart from each other in the first direction x by a first interval d1. The point light sources 8 in the second dimming areas DA21 and DA22 are spaced apart from each other in the first direction x by a second interval d2. The point light sources 8 in the third dimming areas DA31 and DA32 are spaced apart from each other in the first direction x by a third interval d3. The point light sources 8 in the fourth dimming areas DA41 and DA42 are spaced apart from each other in the first direction x by a fourth interval d4. Thus, an inequality of "first interval d1<second interval d2<third interval d3<fourth interval d4" exists.

In an exemplary embodiment of the present invention, the number of the point light sources 8 disposed in the first direction x may be the same for each dimming area. Thus, each length in the first direction x of the first, second, third and fourth dimming areas DA11, DA12, DA21, DA22, DA31, DA32, DA41 and DA42 is longer in a dimming area more distant from the center line C-C'.

When each length in the first direction x of the first, second, third and fourth dimming areas DA11, DA12, DA21, DA22, DA31, DA32, DA41 and DA42 is represented as first, second, third and fourth lengths L1, L2, L3 and L4, an inequality of "first length L1<second length L2<third length L3<fourth length L4" exists.

Figure 3:
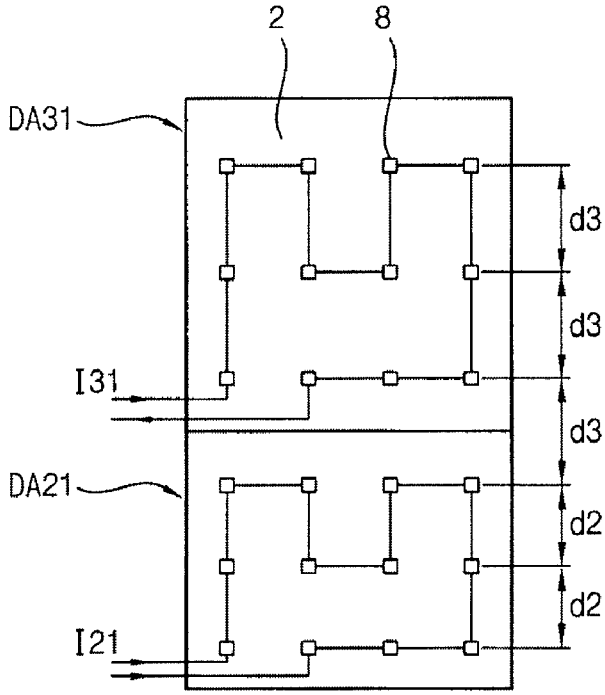
FIG. 3 is a block diagram illustrating the light source module illustrated in FIG. 1.

FIG. 3 is a block diagram illustrating the light source module illustrated in FIG. 1.

Referring to FIG. 3, the second dimming area DA21 and the third dimming area DA31 of the dimming areas corresponding to the first column are illustrated. An electrical connection pattern of the point light sources 8 is substantially the same for each dimming area. The point light sources 8 of three rows and four columns are arranged in each dimming area.

The point light sources 8 in each dimming area are electrically connected to each other in series. There may me multiple available methods of electrically connecting the point light sources 8 in series. In FIG. 3, the point light sources 8 are linearly disposed in row and column directions. Alternatively, the point light sources 8 corresponding to in each column and row may be alternately arranged.

In an exemplary embodiment of the present invention, one driving current is applied to one dimming area. Thus, when power consumption of the point light sources 8 is substantially the same, each point light source 8 generates substantially the same amount of light.

As described above, as the dimming area is distant from the center line C-C', an area of the dimming area becomes greater. Thus, when substantially the same driving current is applied to each dimming area, the luminance of the emitted light from the dimming area becomes smaller as the dimming area is distant from the center line C-C'. Therefore, while the light source module 10 performs a dimming operation, a high driving current is applied to a dimming area distant from the center line C-C' to compensate for a decrease in the luminance of the emitted light due to an increase in area as required.

In the light source module 10 according to an exemplary embodiment of the present invention, where the spatial intervals between the point light sources 8 are as described above, the total number of the point light sources 8 on the power transmission substrate 2 may be reduced in comparison with approaches of the related art where the point light sources 8 are spaced at entirely constant intervals. Thus, the amount of heat dissipation generated by the point light sources 8 may be reduced the operating temperature of the power transmission substrate 2 may be reduced, and the total power consumption may be reduced. As a result, the usable lifespan of the point light sources 8 and the light source module 10 may be increased.

Figure 4:
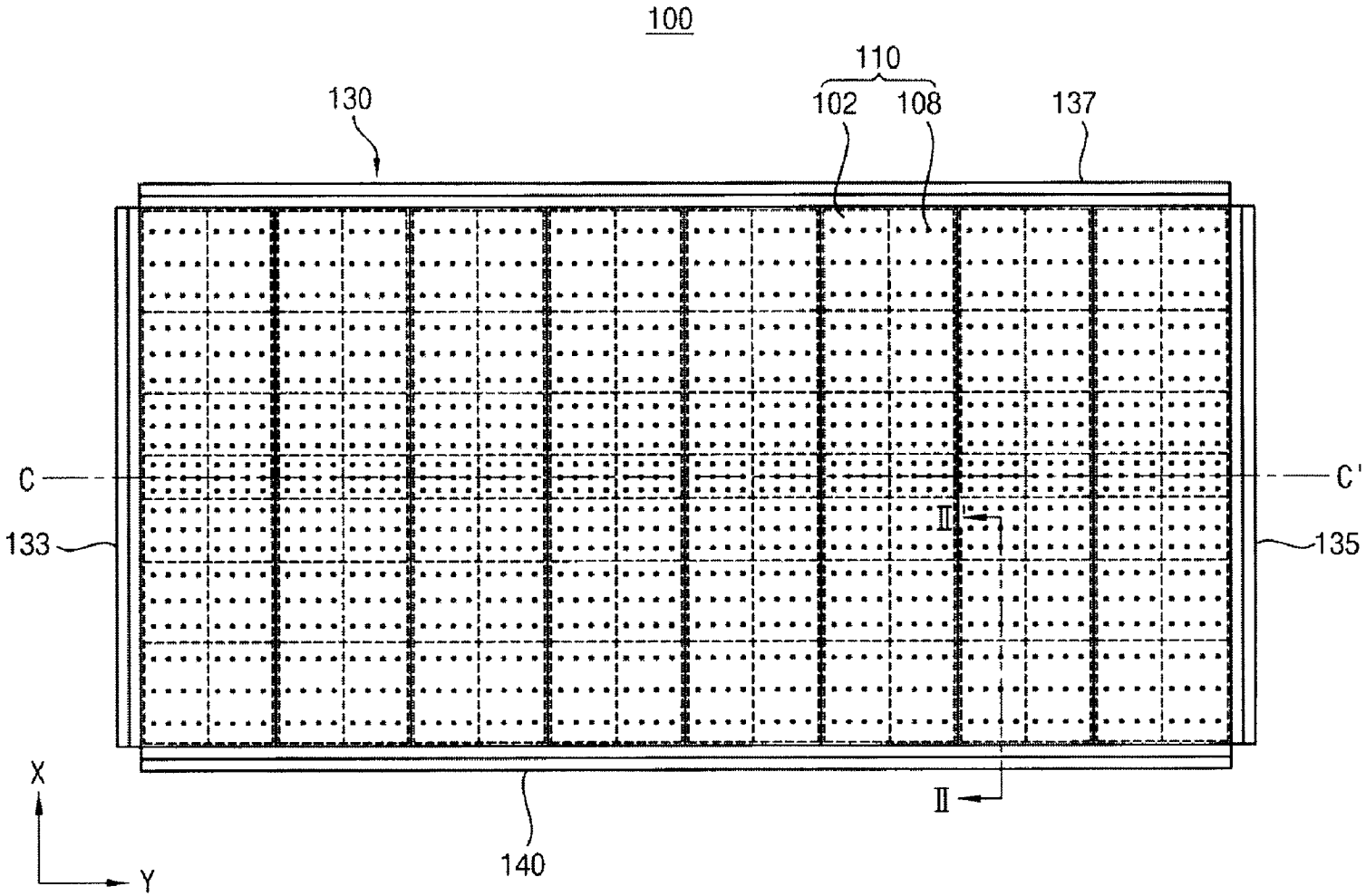
FIG. 4 is a plan view illustrating a light source assembly having the light source module illustrated in FIG. 1.
Figure 5:
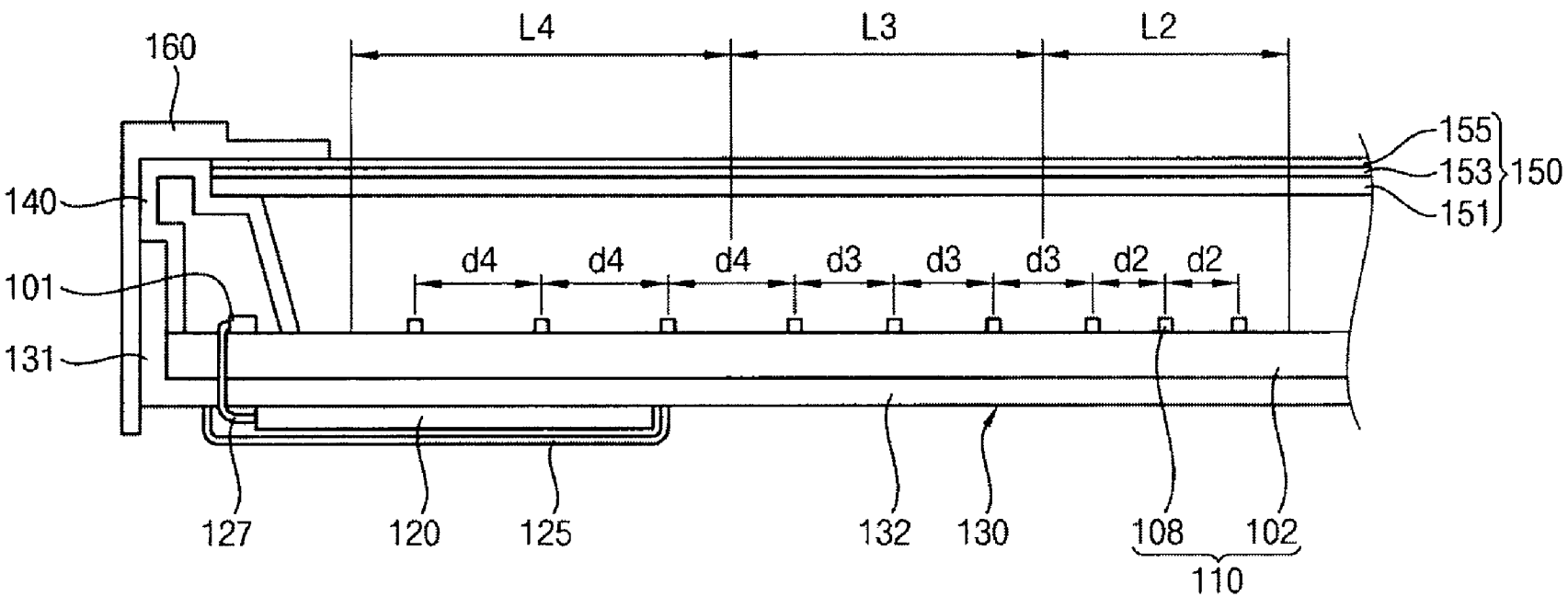
FIG. 5 is a cross-sectional view taken along a line II-II' in FIG. 4.

FIG. 4 is a plan view illustrating a light source assembly having the light source module illustrated in FIG. 1. FIG. 5 is a cross-sectional view taken along a line II-II' in FIG. 4.

Referring to FIGS. 4 and 5, a light source assembly 100 includes a plurality of power transmission substrates 102, a plurality of point light sources 108 and a dimming drive unit 120.

The power transmission substrate 102 and the point light source 108 may be substantially the same as the power transmission substrate 2 and the point light source 8 illustrated in FIGS. 1 to 3.

Each of the power transmission substrates 102 has a plurality of dimming areas disposed in series along the first direction x. A length in the first direction x of each dimming area becomes longer as the dimming area is farther from a center line C-C'. The point light sources 108 are spaced apart from each other by a constant interval within the same dimming area, and the spatial interval in the first direction x between the point light sources 108 becomes greater as the dimming area is more distant from a center line C-C'.

The power transmission substrates 102 are disposed in series along a second direction y substantially perpendicular to the first direction x. In FIG. 4, eight power transmission substrates 102 are disposed in series along the second direction y. Seven rows and two columns of dimming areas are arranged in each power transmission substrate 102. Thus, the light source assembly 100 includes seven rows and sixteen columns of dimming areas. In addition, each dimming area includes three rows and four columns of point light sources 108. The number of the power transmission substrates 102 included in the light source assembly 100 may be modified according to optical characteristics of the emitted light of the light source assembly 100.

The light source assembly 100 may further include a receiving container 130, a side frame 140, an optical member 150 and a middle frame 160.

The receiving container 130 includes a bottom plate 132, on which the power transmission substrates 102 are disposed. The receiving container 130 also includes first, second, third and fourth sidewalls 131, 133, 135 and 137.

The side frame 140 covers a power connection section 101 disposed on side edges of the power transmission substrates 102. The side frame 140 is disposed on the first sidewall 131 of the receiving container 130.

The optical member 150 is disposed over the point light sources 108, and may be supported by an upper face of the side frame 140 and upper portions of the second, third and fourth sidewalls 133, 135 and 137. The optical member 150 may include a light-diffusing plate 151, a light-diffusing sheet 153 and a light-condensing sheet 155.

The middle frame 160 compresses an edge of the optical member 150 and is combined with the receiving container 130.

The dimming drive unit 120 may be disposed on a rear surface of the bottom plate of the receiving container 130. The dimming drive unit 120 may be electrically connected to the power connection section 101 of each power transmission substrate 102 through a wire 127.

The dimming drive unit 120 externally receives a control signal, for example, an image information signal. The dimming drive unit 120 applies a driving current to the point light sources 108 of each dimming area through the power transmission substrate 102 in accordance with the received image information signal. Thus, the dimming drive unit 120 may separately control the luminance of the emitted light from each dimming area.

The light source assembly 100 may further include a protective cover 125 covering the dimming drive unit 120.

Figure 6:
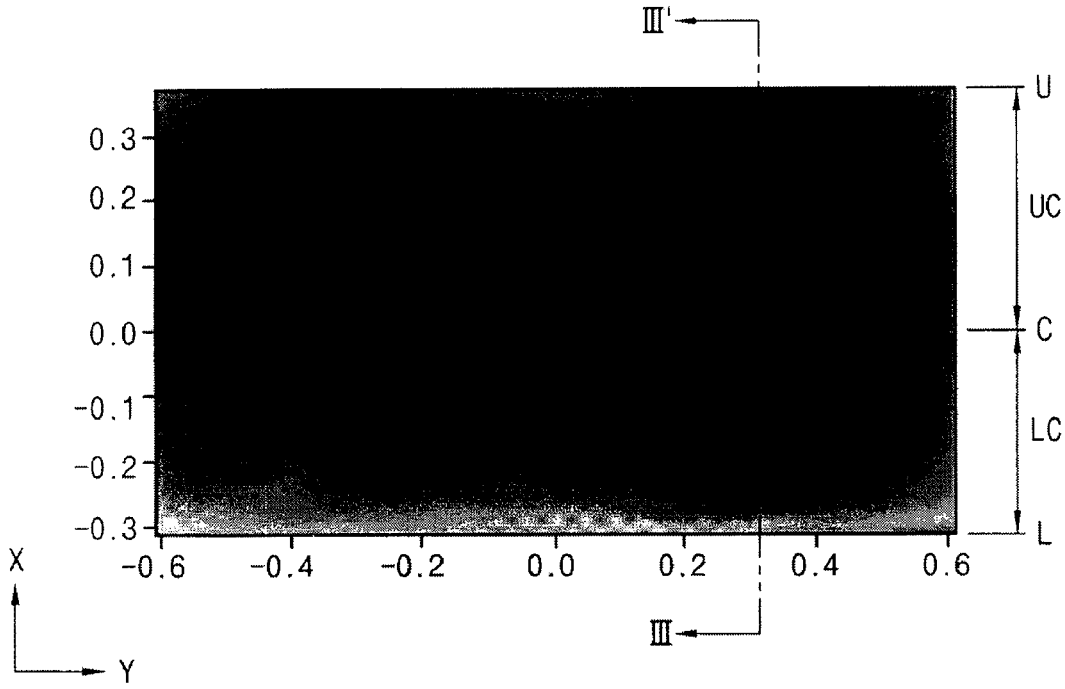
FIG. 6 is a graph showing a luminance distribution of emitted light from the light source assembly illustrated in FIG. 5.
Figure 7:
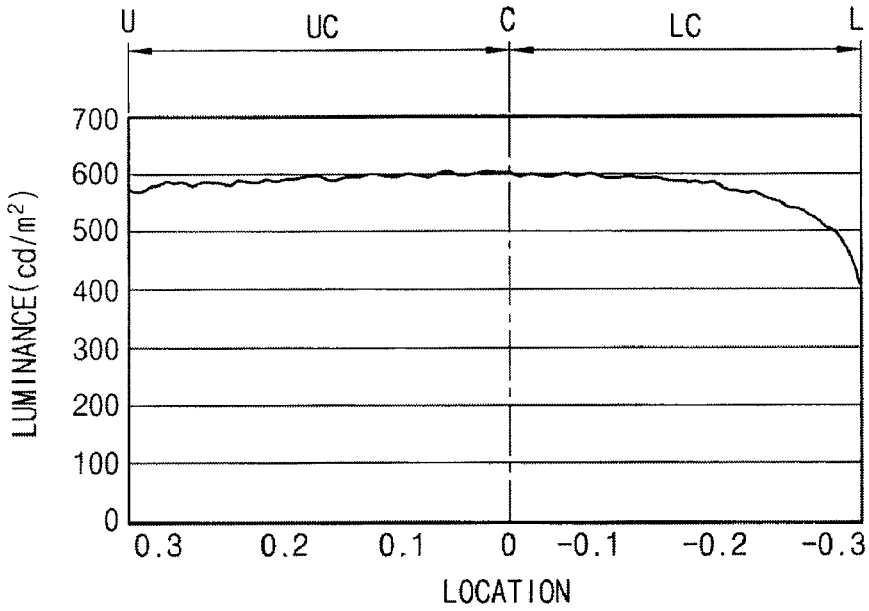
FIG. 7 is a graph showing a luminance distribution of the emitted light observed in a direction III-III' in FIG. 6.

FIG. 6 is a graph showing a luminance distribution of emitted light from the light source assembly illustrated in FIG. 5. FIG. 7 is a graph showing a luminance distribution of the emitted light observed in a direction III-III' in FIG. 6.

In FIG. 6, a vertical axis corresponds to the first direction x, and a horizontal axis corresponds to the second direction y. The center of the graph shown in FIG. 6 substantially corresponds to the center of the light source assembly 100.

In FIGS. 6 and 7, a region LC corresponds to a lower graphic with respect to the horizontal center line C-C'. The region LC shows a luminance distribution of the emitted light from the light source assembly 100 illustrated in FIG. 5, which is observed over the optical member 150 of the light source assembly 100 by using a prometric apparatus.

A region UC corresponds to an upper graphic with respect to the horizontal center line C-C'. The region UC shows a luminance distribution of emitted light when the point light sources 108 are disposed on the power transmission substrate 102 and spaced apart from each other by substantially constant intervals.

Referring to FIGS. 6 and 7, the luminance distribution of the emitted light from the light source assembly 100 according to an exemplary embodiment of the present invention has little difference from a luminance distribution of the emitted light from the point light sources 108 having entirely constant spatial intervals, except for an edge area in the first direction x.

Figure 8:
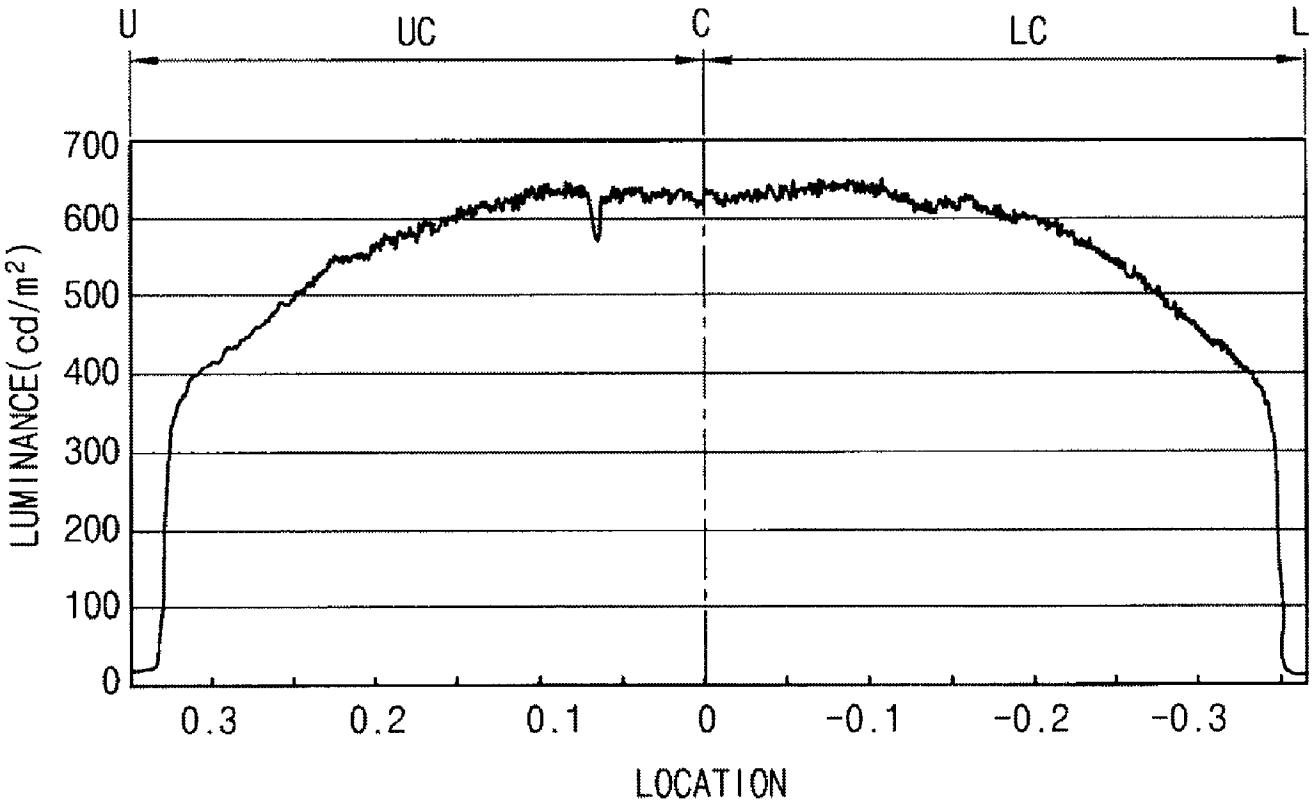
FIG. 8 is a graph showing a luminance distribution of the emitted light from the light source assembly having fluorescent lamps serving as light sources.

FIG. 8 is a graph showing a luminance distribution of the emitted light from the light source assembly having fluorescent lamps serving as light sources.

FIG. 8 shows a luminance distribution of the emitted light observed based on the first direction x when fluorescent lamps serve as a light source of a light source assembly in place of the point light sources 108.

The luminance distribution of the emitted light shown in FIG. 8 may be regarded as a luminance distribution of the emitted light of a widely used backlight assembly of a television set. In FIG. 8, the luminance of the emitted light greatly decreases at upper and lower edge portions in the first direction x.

However, although users are sensitive to luminance variation of a middle area of a display screen, users do not perceive luminance variation of an edge area of a display screen very well. Thus, the luminance distribution of the emitted light illustrated in FIG. 8 may be regarded as a reasonable luminance distribution of a display screen of a commonly used display device.

Referring to FIGS. 7 and 8, it may be ascertained that the luminance distribution of the emitted light of the light source assembly 100 according to an exemplary embodiment of the present invention is almost equivalent to the luminance distribution of the emitted light having commonly used level as described above. Thus, even though the spatial interval between the point light sources 108 is increased as the point light sources 108 are distant from the center, which is similar in light output to the light source assembly 100 discussed above, the light source assembly 100 may be employed in a backlight assembly of a display device without problems.

According to the light source assembly 100 of an exemplary embodiment of the present invention, although the number of the point light sources 108 is reduced, a desired luminance distribution of the emitted light required to a backlight assembly of a display device may be obtained. In addition, since the spatial intervals between the point light sources 108 is substantially constant within the same dimming area, there may be very minimal difference in luminance for the emitted light according to locations in the same dimming area. Also, the total amount of heat dissipation from the point light sources 108 may be reduced to thereby increase the usable lifespan of the point light sources 108 and the light source assembly 100.

Figure 9:
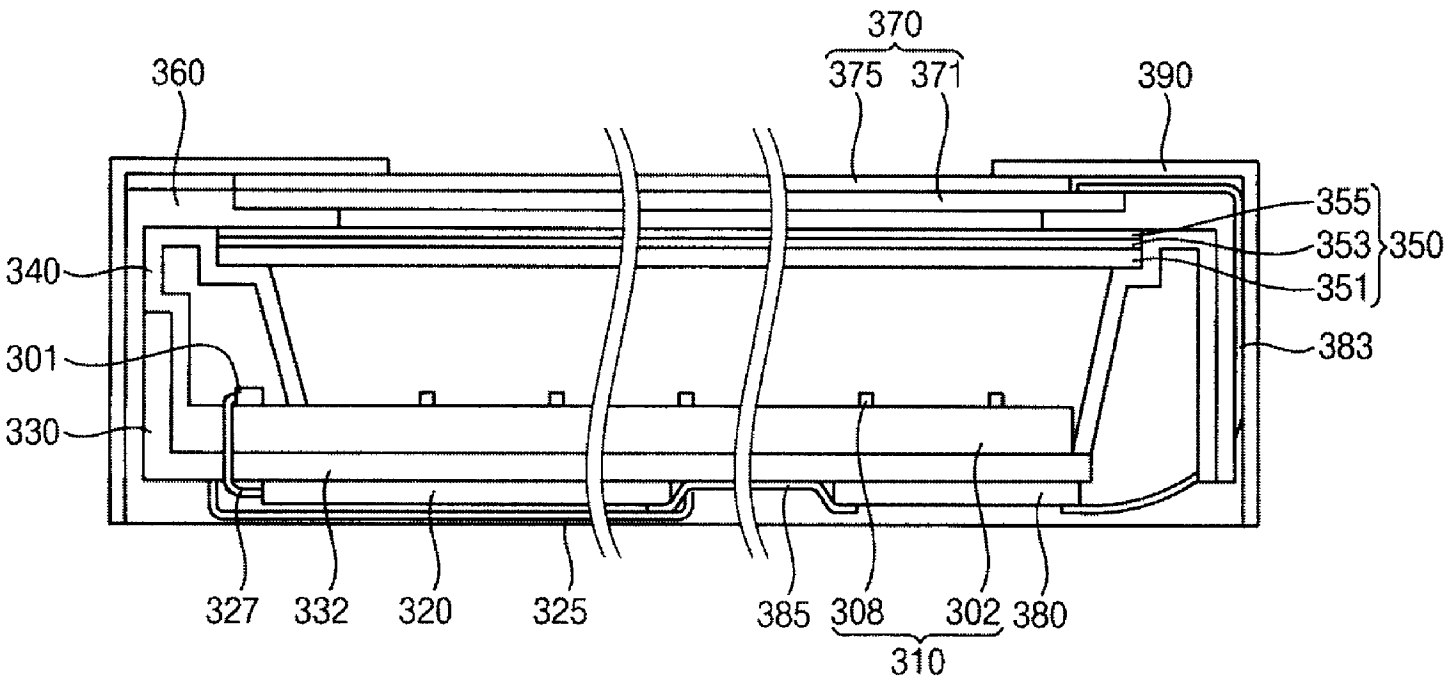
FIG. 9 is a cross-sectional view illustrating a display device having the light source assembly illustrated in FIG. 4.
Figure 10:
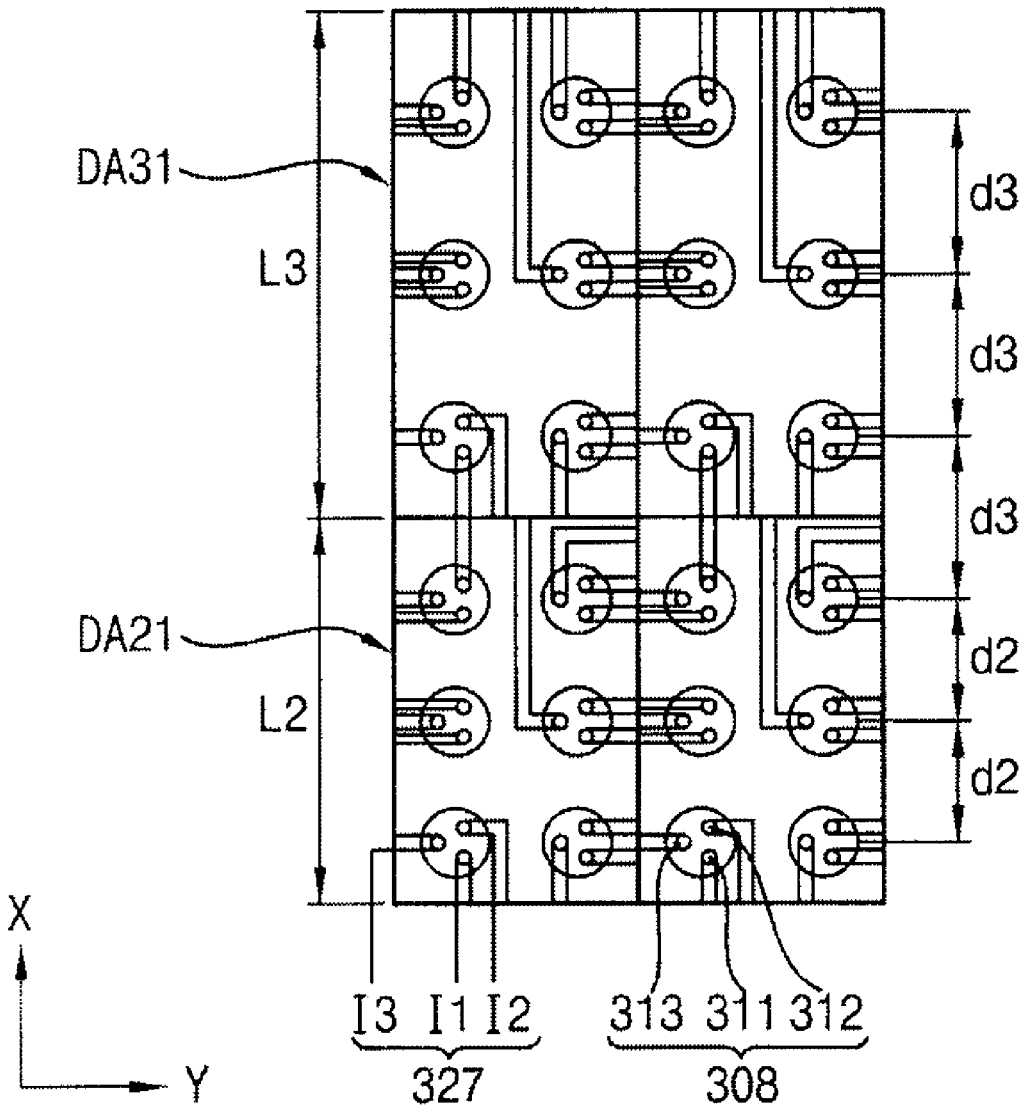
FIG. 10 is a block diagram illustrating a power supply substrate illustrated in FIG. 9.

FIG. 9 is a cross-sectional view illustrating a display device having the light source assembly illustrated in FIG. 4. FIG. 10 is a block diagram illustrating a power supply substrate illustrated in FIG. 9.

Referring to FIGS. 9 and 10, a display device 300 includes a receiving container 330, a plurality of power transmission substrates 302, a plurality of point light sources 308, a display panel module and a dimming drive unit 320.

The receiving container 330 may be substantially the same as the receiving container 130 illustrated in FIGS. 4 and 5.

The power transmission substrate 302 may be substantially the same as the power transmission substrate 2 illustrated in FIGS. 1 to 3 except that, in the power transmission substrate 302 of FIG. 9, three input wirings and three output wirings are connected to one point light source 308.

The point light source 308 includes a first light-generating chip 311 generating first color light, a second light-generating chip 312 generating second color light and a third light-generating chip 313 generating third color light. The first, second and third light-generating chips 311, 312 and 313 may correspond to, for example, a red light-emitting diode (LED), a green LED and a blue LED.

The first, second and third light-generating chips 311, 312 and 313 may be disposed in one housing, or each of the first, second and third light-generating chips 311, 312 and 313 may be disposed in a separate housing. Driving currents 327 are applied to the first, second and third light-generating chips 311, 312 and 313. The driving currents 327 applied to the first, second and third light-generating chips 311, 312 and 313 are controlled by the dimming drive unit 320 described below.

The arrangement of the point light sources 308 may be substantially the same as the arrangement of the point light sources 8 illustrated in FIGS. 1 to 3 except that the number of columns and rows of the point light sources 308 disposed in each dimming area may be reduced. Particularly, as the dimming area is more distant in the first direction x from the center line C-C' of the power transmission substrate 302, the spatial intervals between the point light sources 308 becomes greater. In addition, the spatial interval between the point light sources 308 is substantially constant within the same dimming area.

The display device 300 may further include a side frame 340, an optical member 350, a middle frame 360 and a top chassis 390.

The side frame 340, the optical member 350 and the middle frame 360 may be substantially the same as those illustrated in FIGS. 4 and 5.

The display panel module is supported by the middle frame 360. The display panel module includes a display panel 370, a panel driving substrate 380, a first connecting film 383 and a second connecting film 385.

The display panel 370 includes a lower substrate 371, an upper substrate 375 and a liquid crystal layer (not shown) interposed between the lower and upper substrates 371 and 375.

The first connecting film 383 electrically connects the panel driving substrate 380 and the display panel 370.

The panel driving substrate 380 externally receives an image information signal. The panel driving substrate 380 generates a panel driving signal driving the display panel 370 based on the image information signal. The panel driving substrate 380 outputs the panel driving signal to the display panel 370 through the first connecting film 383.

The second connecting film 385 electrically connects panel driving substrate 380 and the dimming drive unit 320. The dimming drive unit 320 may receive a dimming driving control signal from the panel driving substrate 380. The control signal may include the image information signal.

The top chassis 390 exposes a display screen of the display panel 370 and functions along with the receiving container 330 to support the display device 300.

Figure 11:
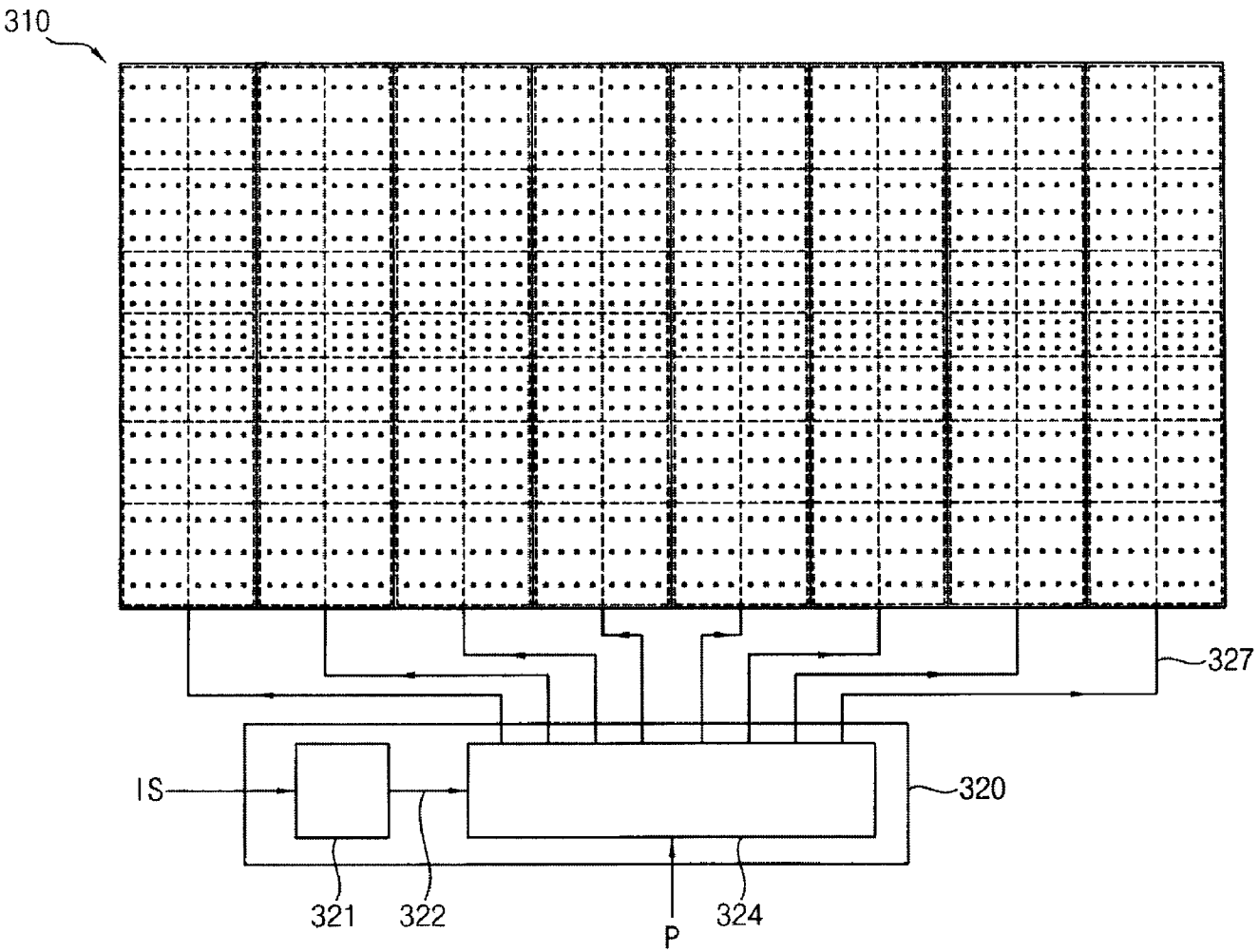
FIG. 11 is a block diagram illustrating a dimming drive unit illustrated in FIG. 9.

FIG. 11 is a block diagram illustrating a dimming drive unit illustrated in FIG. 9.

Referring to FIG. 11, the dimming drive unit 320 separately controls the luminance of light emitted from each dimming area in accordance with the image information signal IS received from the panel driving substrate 380 (FIG. 9). The dimming drive unit 320 separately adjusts the luminance of light emitted from each dimming area corresponding to the luminance of an image displayed in the display panel 370 (FIG. 9). The dimming drive unit 320 may include a dimming control section 321 and a power supply section 324.

The dimming control section 321 may generate a dimming signal 322 in accordance with the received image information signal IS so that the colors of the emitted light corresponds to the colors of the image. The dimming signal 322 commands driving currents 327 applied to the first light-generating chip 311, the second light-generating chip 312 and the third light-generating chip 313 (FIG. 10) in each dimming area.

The dimming signal 322 may corresponds to a pulse width modulation dimming signal. In a pulse width modulation mode, the amount of current flowing in the point light source 308 is controlled by the pulse width modulation dimming signal. For example, pulse width modulation duty is varied in a state of fixing amplitude of pulse current to determine the total amount of current applied to the point light source 308. Thus, the amount and color of the emitted light from each dimming area may be controlled corresponding to the luminance of an image. Alternatively, the dimming signal 322 may change the amplitude of the driving current.

The power supply section 324 generates the driving currents 327 in accordance with the dimming signal 322 based on externally applied power P to output a power connection section formed on the power transmission substrates 302.

The driving currents 327 may control the color of the light emitted from each dimming area so that the first color light, the second color light and the third color light mix to form white light. Alternatively, the driving currents 327 may control the color of the light emitted from each dimming area so that the mixed light has a color corresponding to a color of an area of the image. Thus, the dimming drive unit 320 may have a color dimming operation on the point light sources 308 of each dimming area.

According to the display device 300, although the number of the point light sources 308 is reduced, desired distribution of the emitted light for an image may be obtained. In addition, the total amount of heat dissipation of the point light sources 308 may be reduced to increase the usable lifespan of the point light sources 308 and the display device 300.

Figure 12:
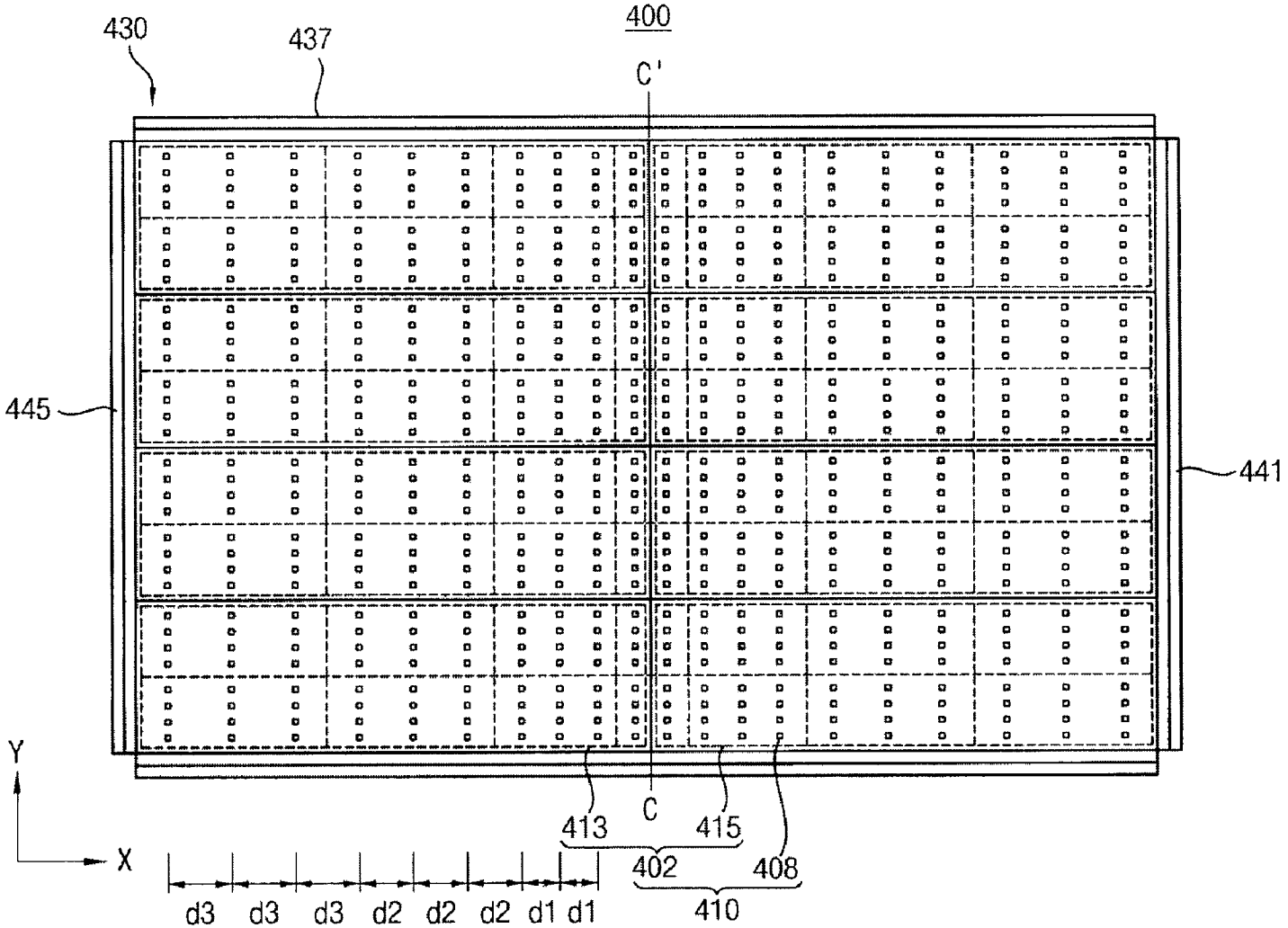
FIG. 12 is a plan view illustrating a light source assembly according to an exemplary embodiment of the present invention.

FIG. 12 is a plan view illustrating a light source assembly according to an exemplary embodiment of the present invention.

Referring to FIG. 12, a light source assembly 400 includes a plurality of light source modules 410, a dimming drive unit (not shown), a receiving container 430, a plurality of side frames 441 and 445, an optical member (not shown) and a middle frame (not shown). The light source assembly 400 also includes a sidewall 437.

The light source assembly 400 may be substantially the same as the light source assembly 100 illustrated in FIGS. 4 to 8 except for including a light source module 410 and a plurality of side frames 441 and 445.

In an exemplary embodiment of the present invention, the light source module 410 includes a plurality of power transmission substrates 402 and a plurality of point light sources 408. The light source module 410 may be substantially the same as the light source module 10 illustrated in FIGS. 1 to 3 except for the power transmission substrates 402.

The power transmission substrate 402 includes two printed circuit boards (PCBs) 413 and 415 disposed in series along the first direction x. For example, the power transmission substrate 402 may be divided into a left PCB 413, left of a centerline C-C' of the power transmission substrate 402 substantially parallel with the second direction y and a right PCB 415, right of a centerline C-C'.

Thus, as the dimming areas are increasingly distant from the center line C-C' and increasingly close to edges of the left and right PCBs 413 and 415, a length in the first direction x of the dimming areas increases. Thus, an inequality of "$d1<d2<d3$" exists.

In addition, as the dimming areas are increasingly distant in the first direction x from the center line C-C', a spatial interval in the first direction x between the point light sources 408 increases. Also, the spatial interval in the first direction x between the point light sources 408 is substantially constant within the same dimming area. Power connection sections are formed on the edges of the left and right PCBs 413 and 415.

In the light source assembly 400, as illustrated in FIG. 12, four power transmission substrates 402 are disposed in series along the second direction y. Thus, eight PCBs 413 and 415 are disposed in two rows and four columns. The rows are substantially parallel with the second direction y, and the columns are substantially parallel with the first direction x.

A first side frame 441 covers a power connection section formed on the edge of the left PCB 413, and is disposed on a first sidewall of the receiving container 430. A second side frame 445 covers a power connection section formed on the edge of the right PCB 415, and is disposed on a second sidewall of the receiving container 430.

The dimming drive unit is connected to power connection sections of the PCBs 413 and 415 to independently drive the PCBs 413 and 415 for dimming.

A display device according to an exemplary embodiment of the present invention may be substantially the same as the display device 300 illustrated in FIGS. 9 to 11 except for the inclusion of the light source assembly 400.

Figure 13:
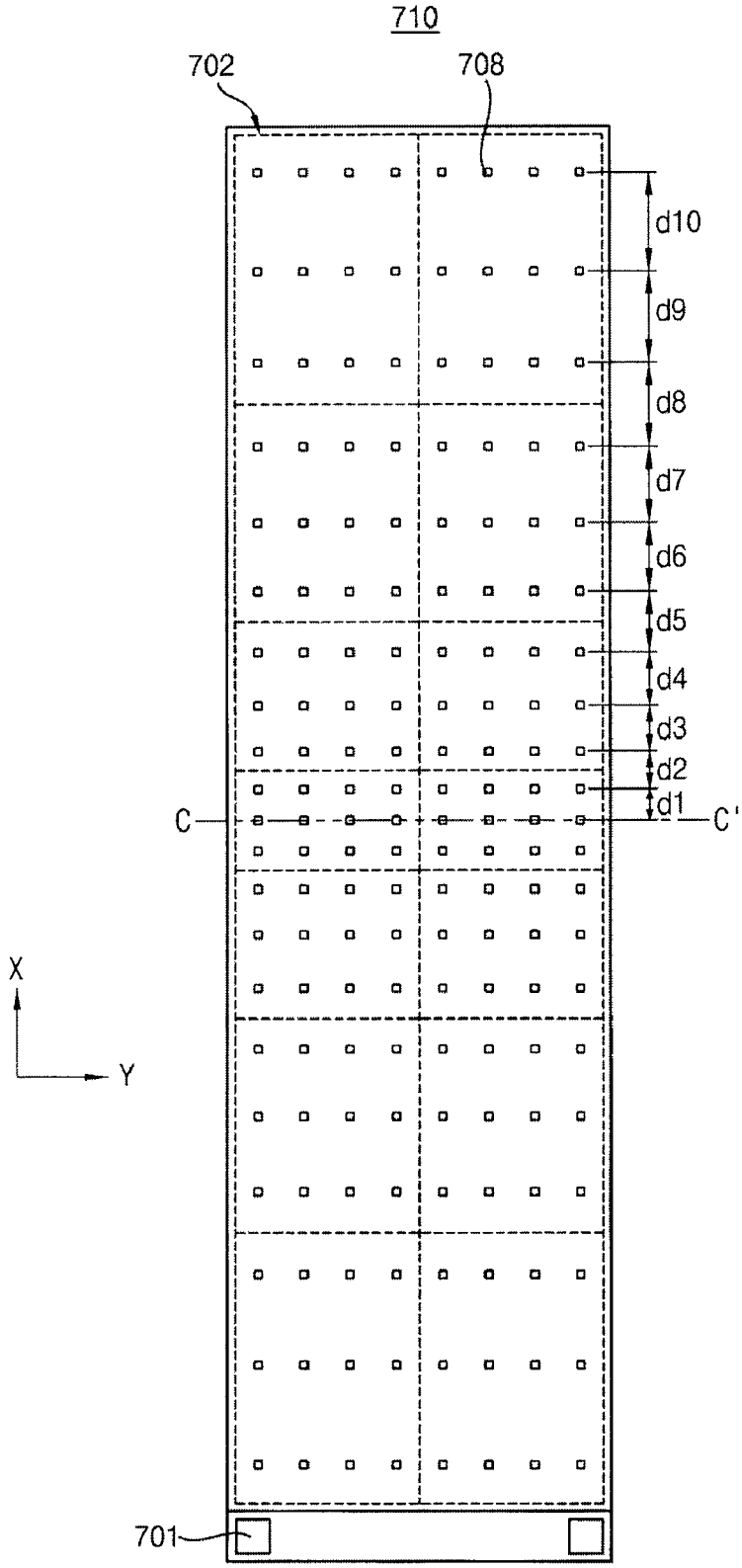
FIG. 13 is a plan view illustrating a light source module according to an exemplary embodiment of the present invention.

FIG. 13 is a plan view illustrating a light source module according to an exemplary embodiment of the present invention.

Referring to FIG. 13, a light source module 710 includes a power transmission substrate 702 and a plurality of point light sources 708. The light source module 710 may be substantially the same as the light source module 10 illustrated in FIGS. 1 to 3 except for the arrangement of the point light sources 708. The light source module 710 may also include a power connection section 701.

In an exemplary embodiment of the present invention, as the point light sources 708 are more distant in the first direction x from a center line C-C' of the power transmission substrate 702, a spatial interval between the point light sources 708 in the same dimming area increases. That is, an equality of "d1<d2<d3<. . . <d8<d9<d10" exists.

In addition, the number of the point light sources 708 disposed in the first direction x may be the same for each dimming area. Thus, as the dimming areas are more distant from the center line C-C', lengths in the first direction x for the dimming areas increase.

A light source assembly according to an exemplary embodiment of the present invention may be substantially the same as the light source assembly 100 illustrated in FIGS. 4 to 8 except for the inclusion of the light source module 710.

A display device according to an exemplary embodiment of the present invention may be substantially the same as the display device 300 illustrated in FIGS. 9 to 11 except for the inclusion of the light source assembly.

Figure 14:
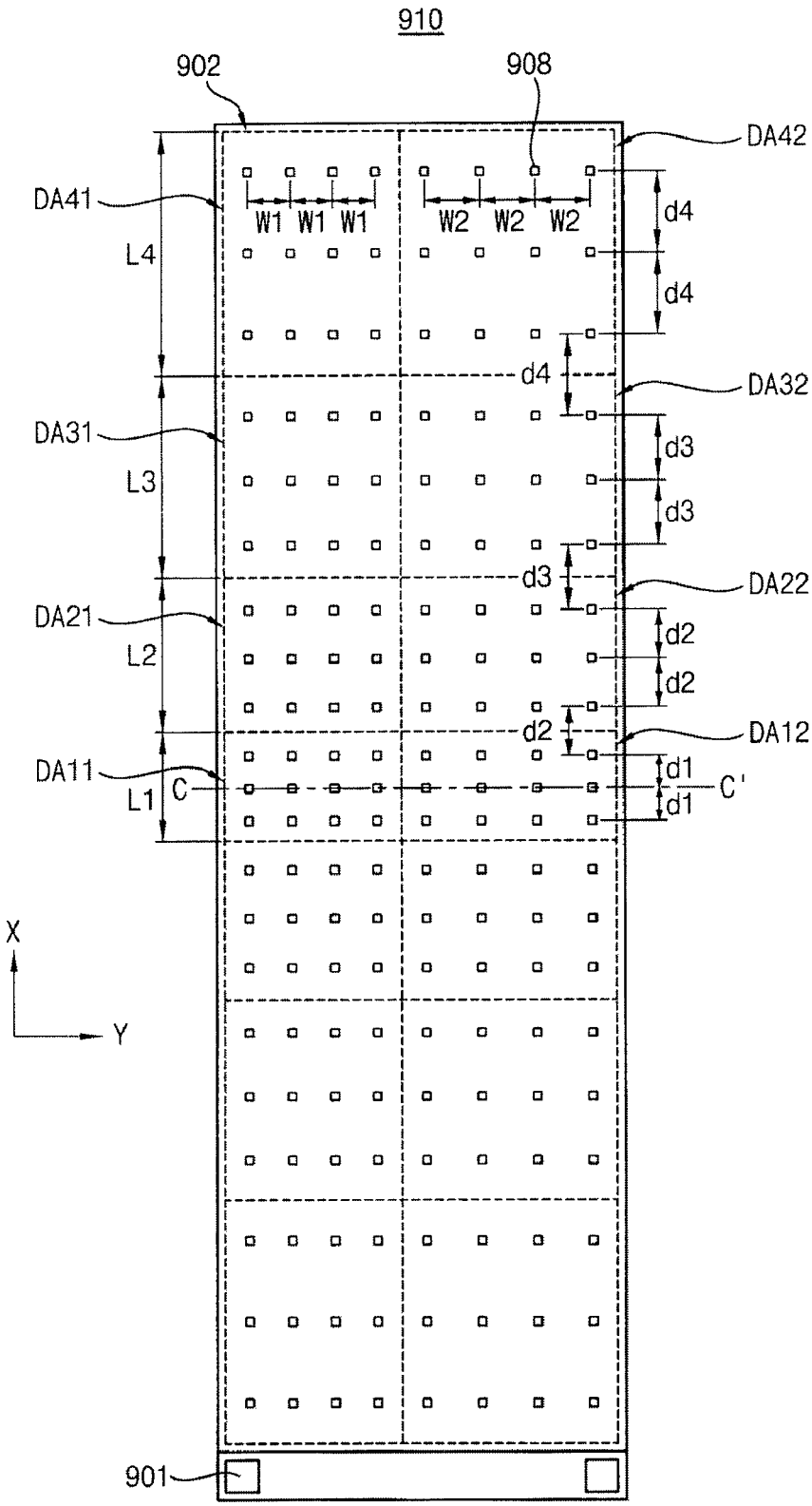
FIG. 14 is a plan view illustrating a light source module according to an exemplary embodiment of the present invention.

FIG. 14 is a plan view illustrating a light source module according to an exemplary embodiment of the present invention.

Referring to FIG. 14, a light source module 910 includes a power transmission substrate 902 and a plurality of point light sources 908. The light source module 910 may be substantially the same as the light source module 10 illustrated in FIGS. 1 to 3 except for the arrangement of the point light sources 908. The light source module 910 may also include a power connection section 901.

In an exemplary embodiment of the present invention, the arrangement of the point light sources 908 may be substantially the same as the arrangement of the point light sources 8 of the light source module 10 illustrated in FIGS. 1 to 3 except that the spatial interval in the second direction y between the point light sources 908 varies from dimming area to dimming area.

The spatial interval in the second direction y between the point light sources 908 is greater in a dimming area more distant from an edge in the second direction y of the power transmission substrate 902 than in a dimming area closer to the edge of the power transmission substrate 902. Particularly, a spatial interval W2 in the second direction y between the point light sources 908 in a dimming area corresponding to a second column is greater than a spatial interval W1 in the second direction y between the point light sources 908 in a dimming area corresponding to a first column. That is, an inequality of "W1<W2" exists.

The spatial interval in the second direction y between the point light sources 908 is substantially constant within the same dimming area. Alternatively, the spatial interval in the second direction y between the point light sources 908 may be greater at a location distant from an edge in the second direction y of the power transmission substrate 902 than at a location closer to the edge of the power transmission substrate 902.

In addition, the number of the point light sources 908 arranged in the second direction y may be the same in each dimming area. Thus, as a distance in the second direction y from the edge increases, a length in the second direction y of the dimming area increases.

The power transmission substrate 902 is long in the first direction x. Thus, the number of the dimming areas disposed in series along the second direction y may be restricted. In FIG. 4, two dimming areas are disposed in series along the second direction y.

Figure 15:
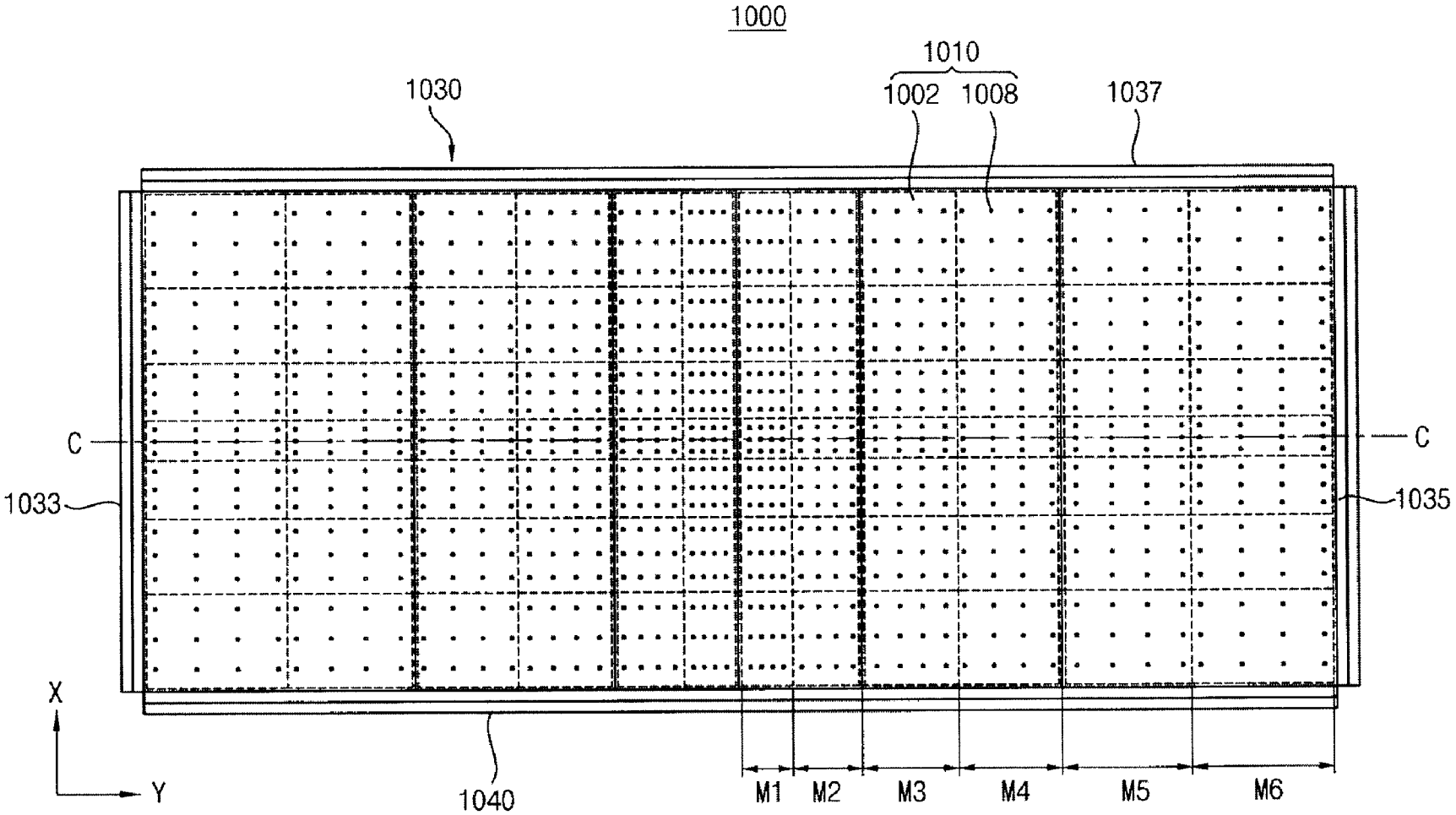
FIG. 15 is a plan view illustrating a light source assembly having the light source module illustrated in FIG. 14.

FIG. 15 is a plan view illustrating a light source assembly having the light source module illustrated in FIG. 14.

Referring to FIG. 15, a light source assembly 1000 may be substantially the same as the light source assembly 100 illustrated in FIGS. 4 to 8 except for the inclusion of a light source module 1010 according to an exemplary embodiment of the present invention. The light source module 1010 may be substantially the same as the light source module 910 of FIG. 14. The light source assembly 1000 may also include a receiving container 1030, sidewalls 1033, 1035, 1037 and a side frame 1040.

As a distance in the second direction y from the center of the light source assembly 1000 increases, a width in the second direction y of the dimming area increases. Accordingly, an inequality of "M1<M2<M3<M4<M5<M6" exists.

Thus, as illustrated in FIG. 15, the width in the second direction y of the power transmission substrate 1002 increases, as a distance from the center of the light source assembly 1000 increases.

A display device according to an exemplary embodiment of the present invention may be substantially the same as the display device 300 illustrated in FIGS. 9 to 11 except for the inclusion of the light source assembly 1000.

According to the light source assembly 1000 and the display device of an exemplary embodiment of the present invention, the spatial interval in the first direction x and the spatial interval in the second direction y between the point light sources 1008 are changed. Thus, the number of point light sources 1008 may be reduced in comparison with some of the light source assemblies discussed above.

Figure 16:
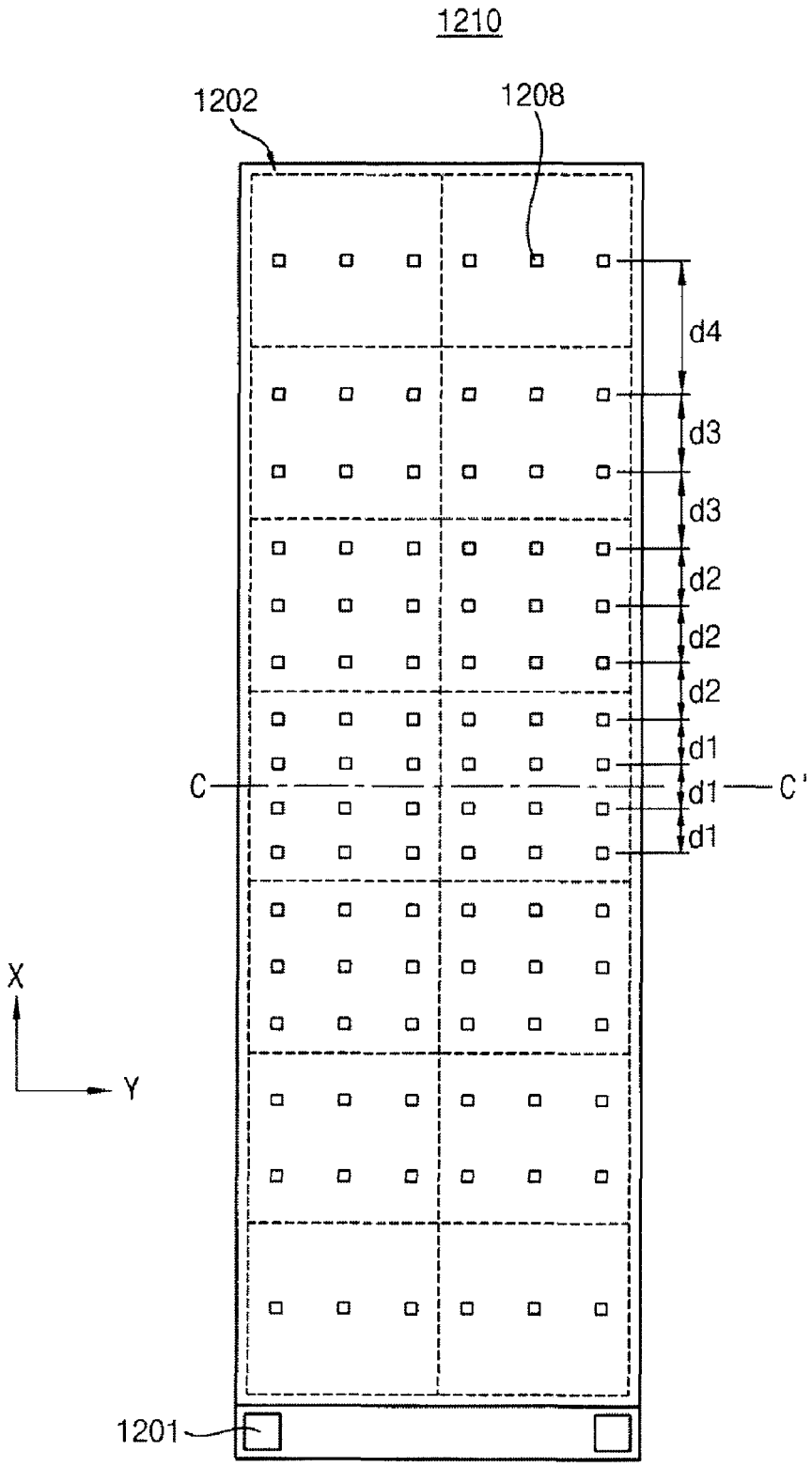
FIG. 16 is a plan view illustrating a light source module according to an exemplary embodiment of the present invention.

FIG. 16 is a plan view illustrating a light source module according to an exemplary embodiment of the present invention.

Referring to FIG. 16, a light source module 1210 includes a power transmission substrate 1202 and a plurality of point light sources 1208. The light source module 1210 may be substantially the same as the light source module 10 illustrated in FIGS. 1 to 3 except for formation of the dimming areas. The light source module 1210 may also include a power connection section 1201.

A length in the first direction x and a length in the second direction y of the dimming areas of the light source module 1210 are substantially constant. A spatial interval in the first direction x between the point light sources 1208 increases, as the dimming area is more distant in the first direction x from a center line C-C' of the power transmission substrate 1202. The spatial interval between the point light sources 1208 in the same dimming area is substantially constant. Thus, the number of the point light sources 1208 disposed in the first direction x of each dimming area decreases as the dimming area is more distant from the center line C-C'.

A light source assembly according to an exemplary embodiment of the present invention may be substantially the same as the light source assembly 100 illustrated in FIGS. 4 to 8 except for the inclusion of the light source module 1210 and the dimming drive unit.

In an exemplary embodiment, the dimming drive unit may be substantially the same as the dimming drive unit 120 illustrated in FIGS. 4 to 8 except for the further inclusion of a compensation circuit. The compensation circuit compensates for the luminance reduction of the emitted light attributable to the reduced number of the point light sources 1208 from dimming area to dimming area.

A display device according to an exemplary embodiment may be substantially the same as the display device 300 illustrated in FIGS. 9 to 11 except for including the light source assembly according to an exemplary embodiment.

Figure 17:
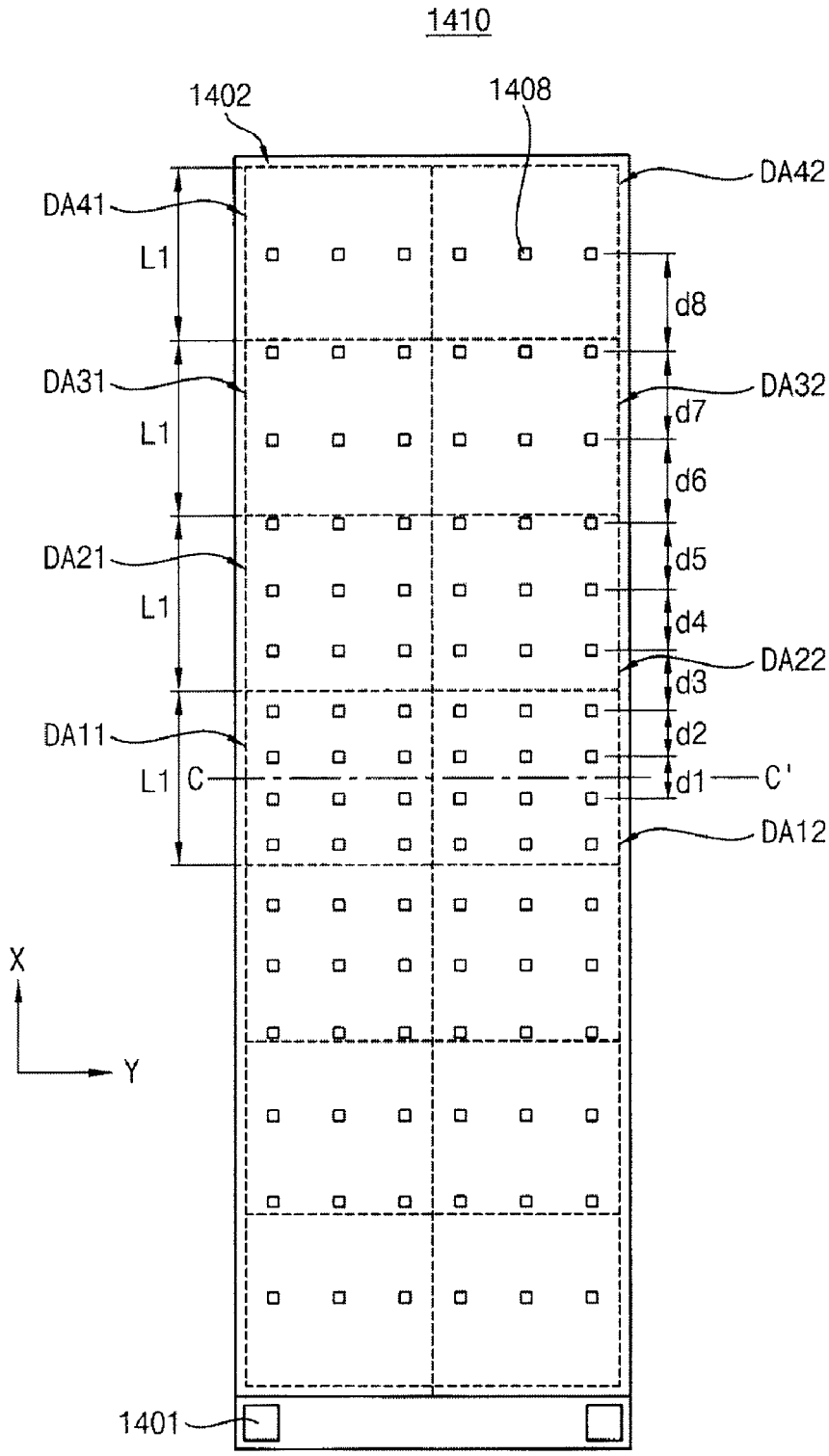
FIG. 17 is a plan view illustrating a light source module according to an exemplary embodiment of the present invention.

FIG. 17 is a plan view illustrating a light source module according to an exemplary embodiment of the present invention.

Referring to FIG. 17, a light source module 1410 includes a power transmission substrate 1402 and a plurality of point light sources 1408. The light source module 1410 may be substantially the same as the light source module 1210 illustrated in FIG. 16 except for the arrangement of the point light sources 1408. The light source module 1410 may also include a power connection section 1401.

In an exemplary embodiment of the present invention, as the point light sources 1408 are more distant in the first direction x from a center line C-C' of the power transmission substrate 1402, a spatial interval between the point light sources 1408 in the same dimming area increases.

A length in the first direction x and a length in the second direction y of the dimming areas are substantially constant. Thus, the number of the point light sources 1408 disposed in the first direction x of each dimming area decreases as the dimming area is more distant from the center line C-C'.

A light source assembly according to an exemplary embodiment of the present invention may be substantially the same as the light source assembly 100 illustrated in FIGS. 4 to 8 except for the inclusion of the light source module 1410.

A display device according to an exemplary embodiment of the present invention may be substantially the same as the display device 300 illustrated in FIGS. 9 to 11 except for the inclusion of the light source assembly.

Figure 18:
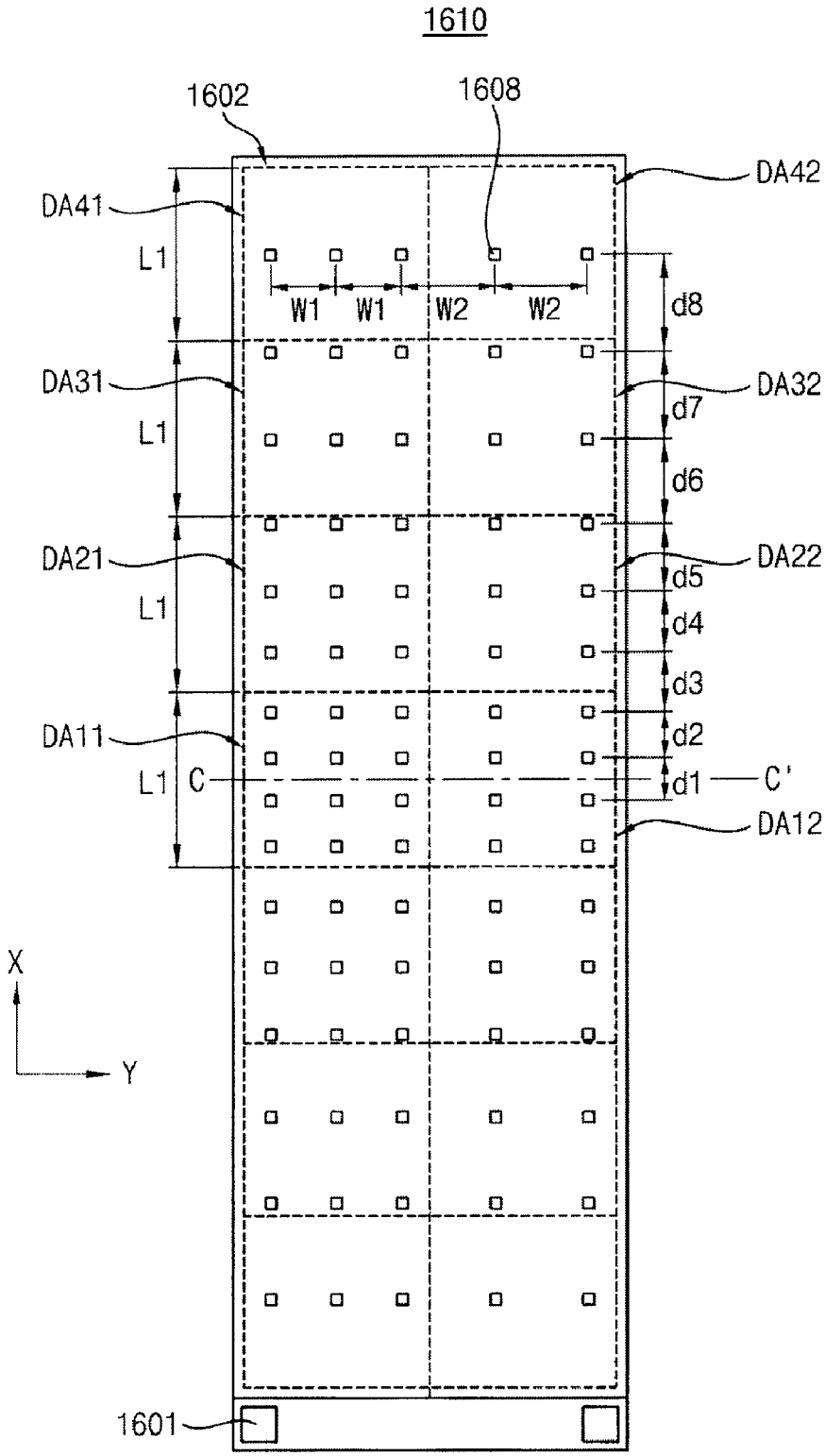
FIG. 18 is a plan view illustrating a light source module according to an exemplary embodiment of the present invention.

FIG. 18 is a plan view illustrating a light source module according to an exemplary embodiment of the present invention.

Referring to FIG. 18, a light source module 1610 includes a power transmission substrate 1602 and a plurality of point light sources 1608. The light source module 1610 may be substantially the same as the light source module 1410 illustrated in FIG. 17 except for the arrangement of the point light sources 1608. The light source module 1610 may also include a power connection section 1601.

In an exemplary embodiment of the present invention, a spatial interval in the second direction y between the point light sources 1608 varies from dimming area to dimming area. The spatial interval in the second direction y between the point light sources 1608 is greater in a dimming area more distant from an edge in the second direction y of the power transmission substrate 1602 than in a dimming area closer to the edge of the power transmission substrate 1602.

Particularly, a spatial interval W2 in the second direction y between the point light sources 1608 in a dimming area corresponding to a second column is greater than a spatial interval W1 in the second direction y between the point light sources 1608 in a dimming area corresponding to a first column.

The spatial interval in the second direction y between the point light sources 1608 is substantially constant in the same dimming area. The number of the point light sources 1608 arranged in the second direction y of each dimming area decreases as the dimming area is more distant in the second direction y from the edge.

A light source assembly according to an exemplary embodiment of the present invention may be substantially the same as the light source assembly 100 illustrated in FIGS. 4 to 8 except for the inclusion of the light source module 1610.

A display device according to an exemplary embodiment of the present invention may be substantially the same as the display device 300 illustrated in FIGS. 9 to 11 except for the inclusion of the light source assembly.

According to the light source module, the light source assembly having the light source module and the display device having the light source module, the arrangement of point light sources of the light source module may be changed to obtain desired display quality even though the number of the point light sources is reduced. Thus, the operating temperature of the point light sources may be reduced and the usable lifespan of the light source module, the light source assembly and the display device may be increased and power consumption may be reduced.

Thus, the light source module, the light source assembly having the light source module and the display device having the light source module may increase optical efficiency in a backlight assembly of the display device and reduce power consumption.

Those skilled in the art will readily appreciate that many modifications are possible in the exemplary embodiments without materially departing from the present invention. Therefore, it is to be understood that the foregoing is illustrative of the present invention and is not to be construed as limited to the specific exemplary embodiments disclosed.

What is claimed is:

1. A light source module comprising:

a power transmission substrate having a plurality of dimming areas disposed along a first direction; and a plurality of point light sources within each of the plurality of dimming areas, receiving driving power applied to each dimming area through the power transmission substrate and generating light, wherein a spatial interval between the point light sources within each dimming area in the first direction is greater for dimming areas of the plurality of dimming areas more distant from the center of the power transmission substrate than for dimming areas of the plurality of dimming areas closer to the center of the power transmission substrate.

2. The light source module of claim 1, wherein a length in the first direction of each dimming area increases as the dimming areas are farther away from the center of the power transmission substrate, as measured along the first direction.

3. The light source module of claim 2, wherein the spatial interval between the point light sources is substantially constant within each of the dimming areas.

4. The light source module of claim 2, wherein as the point light sources are more distant in the first direction from the center of the power transmission substrate, the spatial interval between the point light sources for a given dimming area of the plurality of dimming areas increases.

5. The light source module of claim 2, wherein the number of the point light sources disposed in the first direction is the same for each of the dimming areas.

6. The light source module of claim 1, wherein all of the dimming areas are substantially identical in length in the first direction.

7. The light source module of claim 6, wherein the spatial interval between the point light sources is substantially identical within each of the dimming areas.

8. The light source module of claim 6, wherein as the point light sources are more distant in the first direction from the center of the power transmission substrate, the spatial interval between the point light sources within each dimming area increases.

9. The light source module of claim 1, wherein the point light sources are disposed in a plurality of rows substantially parallel with the first direction in each dimming area, and the dimming areas are disposed in a plurality of rows substantially parallel with the first direction.

10. The light source module of claim 9, wherein the spatial interval between the point light sources is greater in dimming areas more distant in a second direction from an edge of the power transmission substrate than dimming areas closer to an edge in the second direction of the power transmission substrate, wherein the second direction is substantially perpendicular to the first direction.

11. A light source assembly comprising:

a plurality of power transmission substrates each having a plurality of dimming areas disposed along a first direction, the power transmission substrates being disposed along a second direction substantially perpendicular to the first direction;

a plurality of point light sources, within each of the plurality of dimming areas, disposed along the first direction, wherein a spatial interval between the point light sources within each dimming area in the first direction is greater for dimming areas of the plurality of dimming areas more distant in the first direction from the center of the power transmission substrates than for dimming areas of the plurality of dimming areas closer to the center of the power transmission substrates; and a dimming drive unit separately controlling luminance of emitted light from each dimming area by applying driving currents to the point light sources in each dimming area through the power transmission substrates.

12. The light source assembly of claim 11, wherein the number of the point light sources disposed in the first direction is the same for each of the dimming areas.

13. The light source assembly of claim 12, wherein the spatial interval between the point light sources is substantially identical within each of the dimming areas.

14. The light source module of claim 12, wherein as the point light sources are more distant in the first direction from the center of the power transmission substrates, the spatial interval between the point light sources within each dimming area increases.

15. The light source module of claim 11, wherein as the point light sources are more distant in the first direction from the center of the power transmission substrates, the number of point light sources disposed in the first direction corresponding to each dimming area decreases.

16. The light source module of claim 11, wherein the point light sources are disposed in a plurality of rows substantially parallel with the first direction in each dimming area, and the dimming areas are disposed in a plurality of rows substantially parallel with the first direction.

17. The light source module of claim 11, wherein a spatial interval between the point light sources in the second direction is greater in dimming areas more distant from the center of the power transmission substrates than in dimming areas closer to the center of the power transmission substrates.

18. The light source assembly of claim 11, wherein each of the power transmission substrates includes a plurality of printed circuit boards (PCBs) disposed along the first direction, and wherein each of the PCBs is independently driven by the dimming drive unit.

19. The light source assembly of claim 11, wherein the dimming drive unit comprises:

a dimming control section generating a dimming signal that commands the driving currents applied to each dimming area in accordance with an externally received image information signal; and a power supply section generating the driving currents based on externally applied power according to the dimming signal to output the driving currents to a power connection section of the power transmission substrates.

20. A display device comprising:

a receiving container;

a plurality of power transmission substrates each including a plurality of dimming areas disposed along a first direction, wherein the plurality of power transmission substrates are received in the receiving container and are disposed along a second direction substantially perpendicular to the first direction;

a plurality of point light sources within each of the plurality of dimming areas, wherein a spatial interval between the point light sources within each dimming area in the first direction is greater for dimming areas of the plurality of dimming areas more distant from the center of the power transmission substrates than for dimming areas of the plurality of dimming areas closer to the center of the power transmission substrates;

a display panel module disposed over the point light sources to display an image using emitted light from the point light sources; and a dimming drive unit separately controlling luminance of the emitted light from each dimming area in accordance with an image information signal received from the display panel module.

21. The display device of claim 20, wherein each of the point light source comprises:

a first light-generating body generating a first color light;

a second light-generating body generating a second color light; and a third light-generating body generating a third color light.

22. The display device of claim 21, wherein the dimming drive unit comprises:

a dimming control section generating a dimming signal commanding driving currents applied to the first, second and third light-generating bodies of each dimming area in accordance with the received image information signal such that the emitted light corresponds to a color of the image; and a power supply section generating the driving currents based on externally applied power according to the dimming signal to output the driving currents to a power connection section of the power transmission substrates.

23. The display device of claim 22, further comprising:

a side frame that covers the power connection section formed on a side edge of the power transmission substrates and is disposed on a sidewall of the receiving container;

an optical member disposed between the point light sources and the display panel module; and a middle frame combined with the receiving container to compress an edge of the optical member and support the display panel module.

24. The display device of claim 20, wherein a spatial interval between the point light sources in the second direction is greater in dimming areas more distant from the center of the power transmission substrates than in dimming areas closer to the center of the power transmission substrates.

25. The display device of claim 20, wherein each of the power transmission substrates comprises a plurality of PCBs disposed along the first direction, and wherein each of the PCBs is independently driven by the dimming drive unit.

* * * * *